US005142805A

United States Patent [19]

Horne et al.

[11] Patent Number: 5,142,805

[45] Date of Patent: * Sep. 1, 1992

[54] CARTRIDGE MONITORING AND DISPLAY SYSTEM FOR A FIREARM

[76] Inventors: John N. Horne, 2145 B 34th; Michael A. Wolf, 3195 Arizona, both of Los Alamos, N. Mex. 87544

[ * ] Notice: The portion of the term of this patent subsequent to Apr. 9, 2008 has been disclaimed.

[21] Appl. No.: 664,027

[22] Filed: Mar. 4, 1991

Related U.S. Application Data

[63] Continuation-in-part of Ser. No. 458,582, Dec. 29, 1989, Pat. No. 5,005,307.

[51] Int. Cl.[5] ..... F41A 9/62

[52] U.S. Cl. ..... 42/1.02

[58] Field of Search ..... 42/1.01, 1.02, 1.03

[56] References Cited

U.S. PATENT DOCUMENTS 3,552,053 1/1971 Jarvis ..... 42/1.02
4,541,191 9/1985 Morris et al. ..... 42/1.01
5,005,307 4/1991 Horne et al. ..... 42/1.02
5,052,138 10/1991 Crain ..... 42/1.02

FOREIGN PATENT DOCUMENTS 2182424 5/1987 United Kingdom ..... 42/1.02

*Primary Examiner*—Stephen C. Bentley
*Attorney, Agent, or Firm*—William A. Eklund

[57] ABSTRACT

A cartridge monitoring and display system for an automatic or semiautomatic firearm. A programmed microcontroller receives input signals from each of a slide switch and a magazine switch, which switches generate respective signals upon actuation of the firearm slide and upon insertion or withdrawal of a cartridge magazine. The microcontroller calculates the number of rounds remaining in the firearm and displays the number on an LCD display. A visible and audible warning is given when the cartridge count drops below a predetermined minimum level. The entire system is incorporated in a mounting strap which may be inserted between the frame and hand grip of a conventional semiautomatic pistol.

10 Claims, 12 Drawing Sheets

CARTRIDGE MONITORING AND DISPLAY SYSTEM FOR A FIREARM

This is a continuation-in-part of copending application Ser. No. 07/458,582 filed on Dec. 29, 1989 and now issued as U.S. Pat. No. 5,005,307.

BACKGROUND OF THE INVENTION

1. Field of the Invention

The invention described and claimed herein is generally related to firearms having integrally contained systems for monitoring and displaying the supply of ammunition in the firearm, such as a semiautomatic or automatic pistol or rifle.

2. Description Of Related Art Including Information Disclosed Under 37 CFR 1.97-1.99

Automatic and semiautomatic firearms do not contain any means for indicating the number of rounds of ammunition contained in the firearm. As a result, a well recognized problem in both competitive and combat shooting situations is the inability of the firearm user to be confidently certain at all times of the number of rounds of ammunition remaining in his firearm, particularly after some ammunition has been expended.

A user will typically know the maximum cartridge capacity of his firearm, and thus will usually know the number of rounds that the firearm initially contains upon loading. Thus, the initial cartridge count is not ordinarily a problem.

After firing the firearm, however, the user will typically be far less certain of the number of rounds remaining. With automatic weapons the user will only have a general idea of the number of rounds remaining after a burst of rounds has been fired from the firearm. Only through experience can a user even estimate how many rounds might be left after firing a burst, and even then such an estimate is only approximate. Nevertheless, in both competitive and combat shooting it is critical that a shooter not overestimate the amount of ammunition remaining in his firearm, and thereby run out of ammunition at a critical moment when it may be necessary to fire. At the same time, tactical considerations dictate that a shooter should make optimum use of his firearm, by using as much ammunition as possible before each reloading. These competing considerations make it desirable for the user to know exactly how much ammunition remains in his firearm at all times.

Even with a semiautomatic weapon, where each cartridge is individually fired by the user, it is frequently difficult to be certain of the number of cartridges remaining. If the semiautomatic weapon contains only a limited number of cartridges, for example a semiautomatic pistol, the user may be able to mentally keep track of the number of cartridges fired, and thereby calculate the number of cartridges remaining. However, during the stress of a combat situation or a competitive shooting event a user will frequently be unable to keep track of the number of cartridges that have been fired and thus will not be certain of the number of cartridges remaining in the firearm, even in the case of pistol having a capacity of on a few rounds.

This lack of certainty, as to the supply of ammunition remaining in the firearm, is a primary limitation on the user's ability to assess and respond to tactical situations where snap decisions must be made whether to shoot, reload, or take other appropriate tactical actions.

SUMMARY OF THE INVENTION

Accordingly, it is the object and purpose of the present invention to provide a firearm having an integrally contained system for monitoring and visually displaying the number of rounds of ammunition contained in the firearm.

It is also an object and purpose of the present invention to provide a device for monitoring and displaying the number of cartridges contained in a semiautomatic or automatic firearm, particularly a semiautomatic pistol.

It is another object and purpose of the present invention to attain the foregoing objects in a system which automatically accommodates reloading of the firearm, and which also alerts the user when the supply of ammunition in the firearm has been expended to a predetermined low level.

It is yet another object of the present invention to provide a system which monitors and records the number of rounds fired from a firearm.

It is another object of the present invention to provide a system which detects and records the firing of a firearm as well as the insertion of a magazine into the firearm, with a minimum of mechanical moving parts.

The foregoing objects and purposes are attained in the present invention, which provides a system for monitoring and visually displaying the supply of ammunition in a semiautomatic or automatic firearm having a frame and a slide means. The slide means may be the conventional slide of a semiautomatic pistol, or it may be, for example, the bolt or bolt carrier of an automatic or semiautomatic rifle. In general, the present invention is applicable to any firearm which is loaded by means of a cartridge magazine and which has a slide element which slides relative to the frame upon firing of the firearm. The cartridge monitoring and display system of the present invention includes a slide switch which is operable to produce a slide signal upon sliding of the slide to the frame; a magazine switch affixed to the frame which is operable to generate a magazine signal upon insertion or withdrawal of a magazine from the firearm; a programmed control circuit which is operable to receive the slide and magazine signals; and a visual display unit affixed to the firearm. In operation control circuit operates to receive the slide and magazine signals and produce on the visual display unit a readout of the number of cartridges in the firearm.

In a preferred embodiment the slide switch, the magazine switch, the programmed control circuit and the visual display unit are all integrally contained in a mounting strap which is readily insertable between the frame and the hand grip of a conventional firearm.

In an alternative preferred embodiment the slide switch and the magazine switch each include piezoelectric sensors which produce an electric signal. The piezoelectric sensors are embedded in flexible detents which are flexed by motion of the firearm slide or as the magazine is inserted or withdrawn from the firearm.

It should be understood that although the present invention will be described herein with reference to a semiautomatic pistol, the invention will be also applicable to and useful in any automatic or semiautomatic firearm in which there is a slide element that moves rearwardly with respect to the firearm frame upon firing of the firearm.

The present invention has useful application in the law enforcement community, possibly also in the military, and perhaps most significantly, in the short term, among competitive combat shooting enthusiasts.

These and other aspects of the present invention will be more apparent upon consideration of the following detailed description of the invention, when taken with the accompanying drawings.

BRIEF DESCRIPTION OF THE DRAWINGS

The Figures set forth in the accompanying drawings form a part of this specification and are hereby incorporated by reference. In the Figures.

DESCRIPTION OF THE PREFERRED EMBODIMENT

Figure 1:
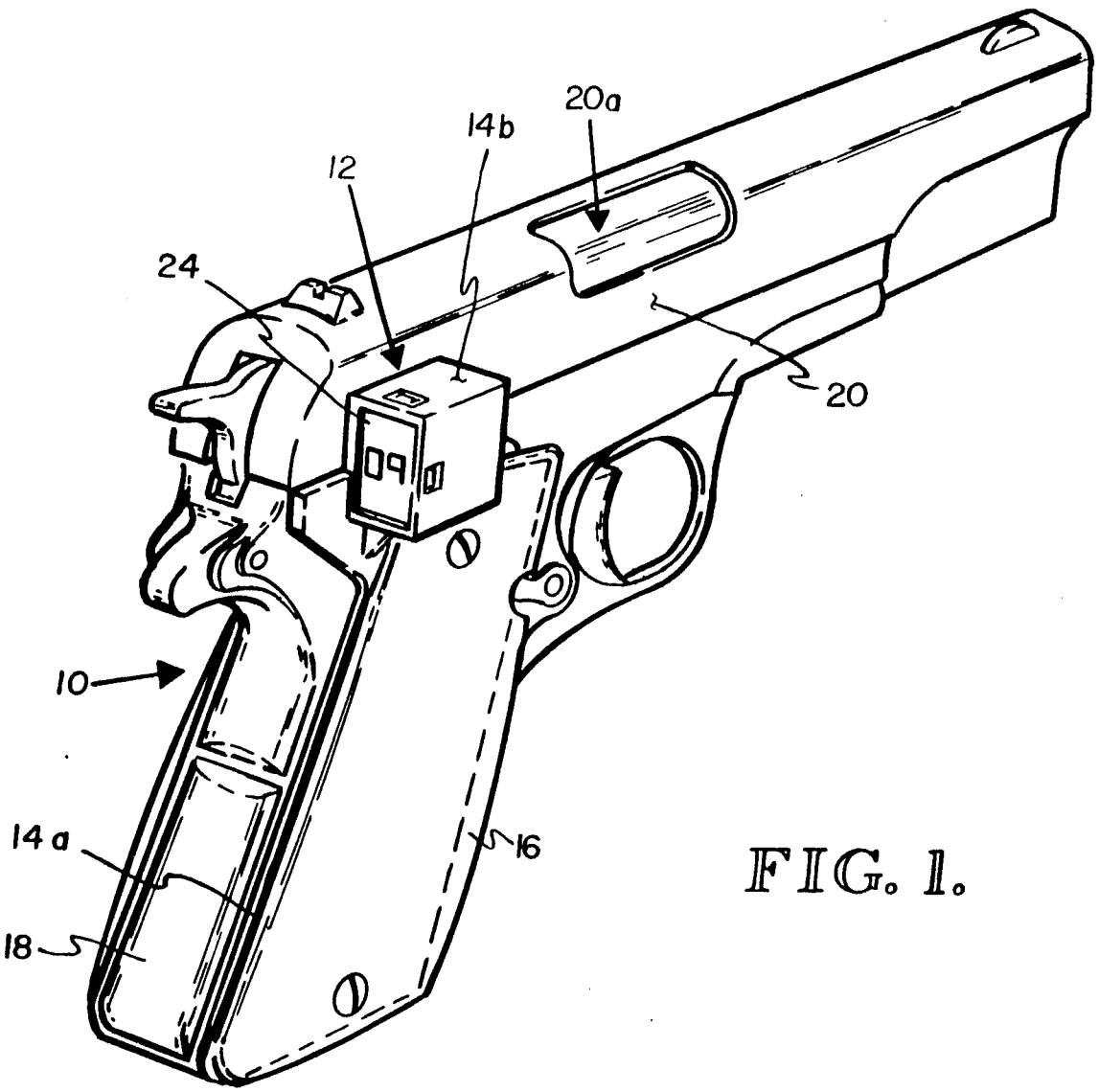
FIG. 1 is an isometric view of a semiautomatic pistol provided with a preferred embodiment of the cartridge monitoring system of the present invention, which is integrally contained within a mounting strap that is enclosed between the frame and handgrip of the pistol.

Referring to FIG. 1, there is illustrated a preferred embodiment of a semiautomatic pistol 10 equipped with a cartridge monitor and display system 12 provided in accordance with the present invention.

Figure 2:
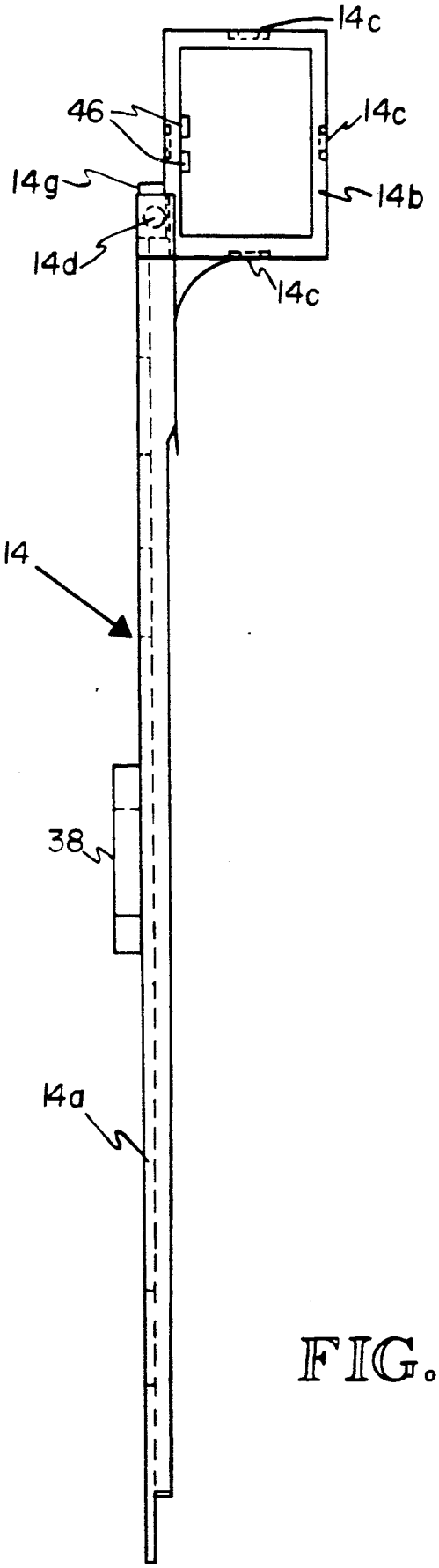
FIG. 2 is an end view of the mounting strap of the cartridge monitor fitted to the pistol shown in FIG. 1.
Figure 3:
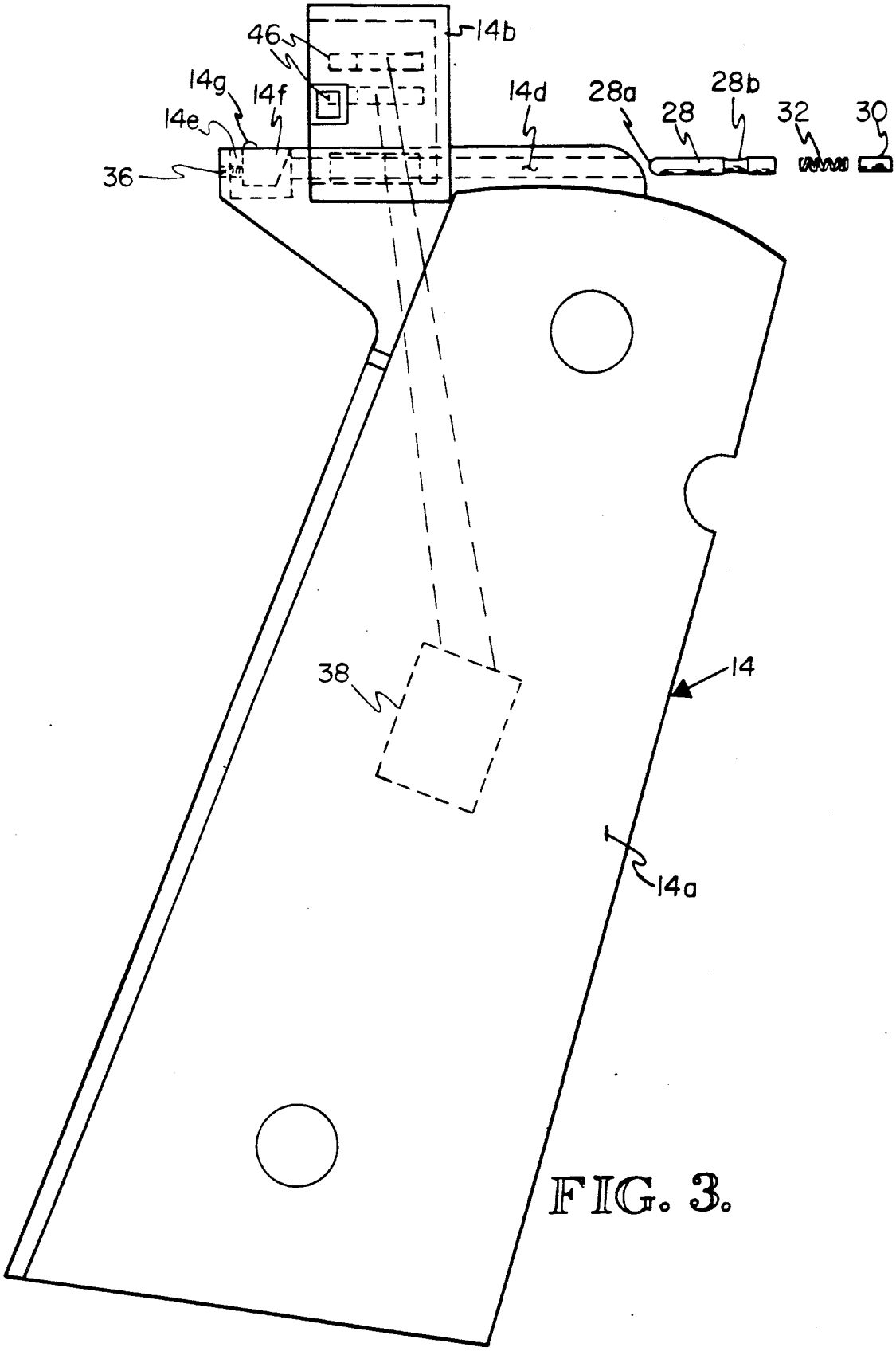
FIG. 3 is a side view of the mounting strap of FIG. 2, with other mechanical components shown in exploded view.
Figure 4:
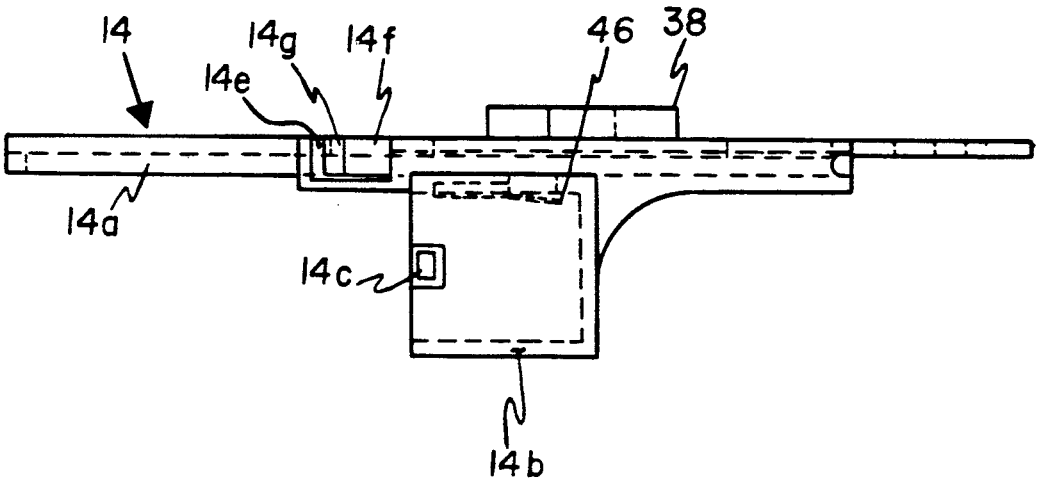
FIG. 4 is a plan view of the mounting strap of FIG. 2.

Briefly, the cartridge monitor and display system 12 includes a polymeric strap 14 which includes a flat lower portion 14*a* and an integral rectangular housing 14*b* at its upper end, shown also in FIGS. 2 through 4. The lower portion 14*a* of the strap 14 is thin and flat, and is enclosed between the conventional right-hand grip 16 and frame 18 of the pistol 10. The lower portion 14*a* of the strap 14 is sufficiently thin that it can be interposed between the frame 18 and grip 16 without substantially affecting the feel or performance of the pistol 10.

As noted above, the integral housing 14*b* extends from the upper end of the strap 14, and is positioned adjacent the rear end of the slide 20 of the pistol 10. The housing 14*b* opens rearwardly and contains an electronics module 22 (not shown in FIG. 1; described further below with reference to FIGS. 8 through 11). The electronics module 22 includes a liquid crystal display (LCD) unit 24, which also faces rearwardly. As described in detail below, the LCD unit 24 displays the number of cartridges contained in the pistol 10.

The electronics module 22, responding to input signals from a pair of switch sensors described below, monitors the firing of cartridges from the pistol 10. After each shot the electronics module 22 calculates the number of cartridges remaining in the pistol 10 and displays the number on the LCD 24, as described further below.

Referring particularly to FIGS. 2 through 4, the mounting strap 14 and its associated integral housing 14*b* are formed of an injection molded polymeric material, preferably an acetal polymer. The lower portion 14*a* of the mounting strap 14 is thin and flat and is generally in the outline of the conventional hand grip 16 of the automatic pistol 10, with however the incorporation of the hollow housing 14*b* integrally attached at the upper end of the mounting strap 14.

Figure 5:
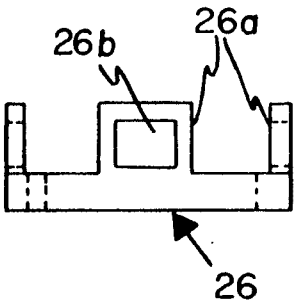
FIG. 5 is a plan view of a bezel for retaining an electronic module in the housing of the mounting strap.
Figure 7:
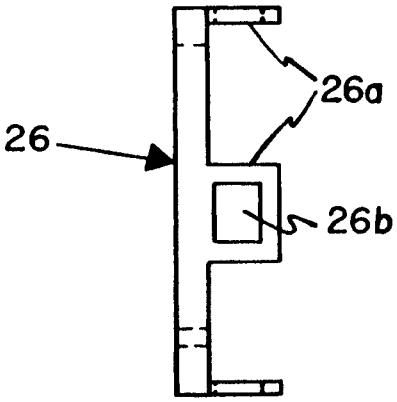
FIG. 7 is a side view of the bezel of FIG. 5.
Figure 6:
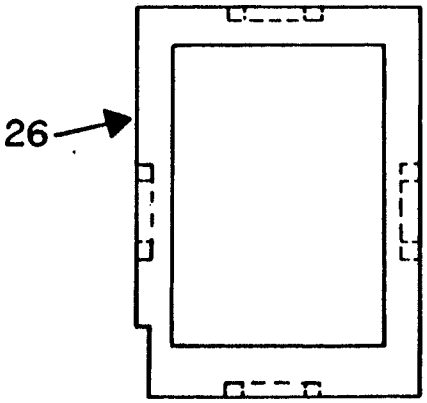
FIG. 6 is a front view of the bezel of FIG. 5.

The four outer surfaces of the housing 14*b* include four recesses 14*c* which are positioned adjacent to and centered on the open rear end of the housing 14*b*, each recess 14*c* having a ramped protrusion extending from its base. The protrusions in the recesses 14*c* function to retain a rectangular frame bezel 26. The bezel 26, shown in FIGS. 5 through 7, includes four integral retaining ears 26*a*, each with a rectangular hole 26*b*. The retaining ears 26*a* snap into position over the ramped protrusions in the recesses 14*c* of the housing 14*b*, so as to retain the electronic module 22 inside the housing 14*b*.

The mounting strap 14 further includes a bore 14*d*, which extends alongside the base of the housing 14*b*. The bore 14*d* opens at its rear end into an upwardly opening recess 14*e* which is integrally formed at the rear, upper end of the mounting strap 14. A stainless steel plunger 28 is contained in the bore 14*d*. The plunger 28 includes a rounded rear end 28*a*, and a detent 28*b* in its midsection. The bore 14*d* is closed at its forward end by means of an acetal plug 30 which is adhesively secured in place. A coil spring 32 is positioned between the plug 30 and the plunger 28. The spring 32 urges the plunger 28 toward the recess 14*e*. The plunger 28, spring 32 and plug 30 are shown in exploded view in FIG. 3.

The upwardly opening recess 14*e* contains an integral actuator hinge 14*f*, which in turn includes an integral, upwardly protruding cam 14*g*. The actuator hinge 14*f* is integrally attached to, and is part of, the mounting strap 14. The hinge 14*f* is attached to the body of the strap 14 by means of an integral strip of acetal polymer, which is in the nature of a living hinge, as that term is known in the plastics industry; that is, it is an integral part of the strap 14 and swings on a small strip of polymeric acetal that extends from the body of the strap 14.

As noted above, the pistol 10 includes generally a slide 20 and a frame 18, with the strap 14 being captured between the frame 18 and the conventional grip 16.

Upon each firing of the pistol, the slide 20 slides rearwardly on the frame 18 and then returns, with a spent cartridge shell being ejected through the conventional ejector opening 20*a* in the slide 20, and a new cartridge being loaded into the chamber of the pistol 10 from the magazine (not shown). The slide 20, frame 18, magazine and other major mechanical components of the pistol are conventional in design and operation.

As the slide 20 moves rearwardly, it engages the actuator cam 14*g* and depresses it downwardly, causing the actuator hinge 14*f* to be depressed downwardly as well. Downward depression of the actuator hinge 14*f* in turn causes the hinge 14*f* to drive the plunger 28 forward within the bore 14*d*. Forward motion of the plunger 28 in the bore 14*d* causes the detent 22*b* of the plunger 28 to displace a plunger of a slide switch 34, which extends from the electronic module 22 through a hole in the wall of the housing 14*b*, and which in the normal rest position rests in the detent 22*b* of the plunger 28. Actuation of the slide switch 34 results in a generation of a slide signal to the programmed electronic control circuitry described below. In its normal rest position, the rear end of the plunger 28 urges against the angled face of the actuator hinge 14*f*. A set screw 36 prevents the hinge 14*f* from being driven upwardly by the plunger 28.

A magazine switch 38 is located on the inside of the mounting strap 14. The magazine switch 38 is a pressure sensitive switch which extends through an opening of the pistol frame 18 so as to be in contact with a magazine in the pistol. The magazine switch 38 is closed each time a magazine is inserted in the pistol, transmitting a signal through a pair of wires embedded in the inside surface of the strap 14, to the electronics module 22 in the housing 14*b*.

Figure 8:
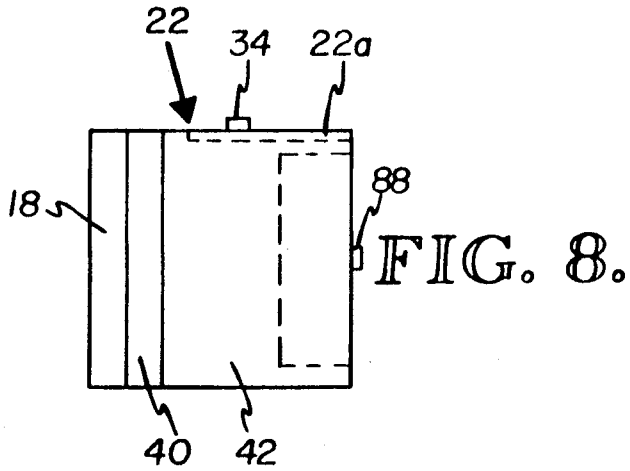
FIG. 8 is a plan view of the electronic module of the cartridge monitoring system.
Figure 9:
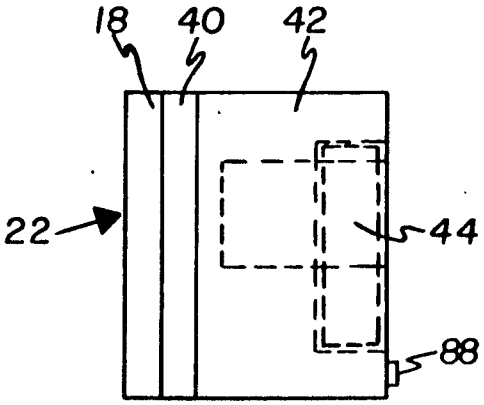
FIG. 9 is a side view of the electronic module of FIG. 8.
Figure 10:
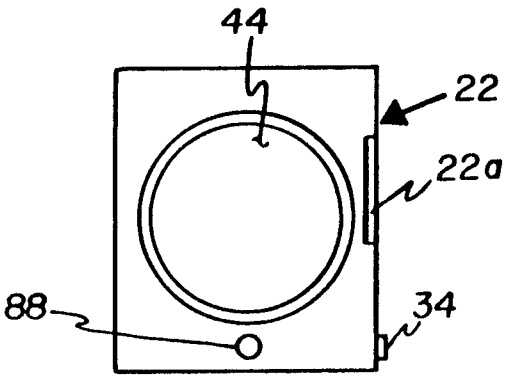
FIG. 10 is an end view of the electronic module of FIG. 8.

Referring to FIGS. 8 through 10, the electronics module 22 includes the LCD display unit 24, a tritium back light plate 40, an epoxy-embedded electronic circuit 42, and a battery 44. A pair of leaf spring electrical contacts 46 (FIG. 2) extend from the inside wall of the housing 14*b* and operate to connect the electronics module to the embedded leads from the magazine switch 38. The entire module 22 is generally cubic in shape, so that it may be inserted into the housing 14*b* and retained by the bezel 26. A small recess 22*a* on the inside wall of the module 22 accommodates the leaf spring contacts 46, and contains electrical leads connecting the spring contacts 46 to the electronic control circuit described below.

Figure 11:
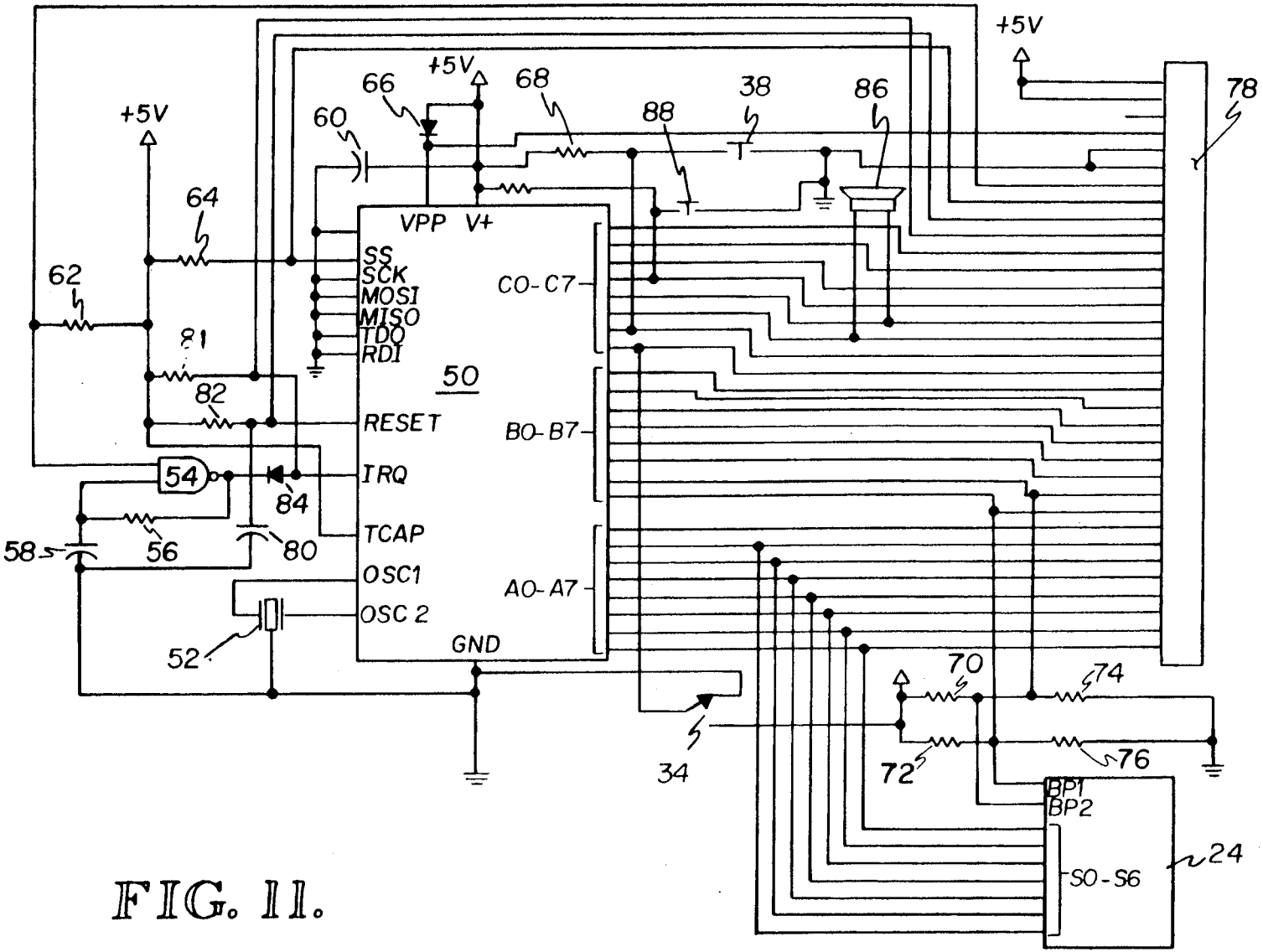
FIG. 11 is a schematic diagram of the electronic programmed control circuit contained in the electronic module.

The epoxy embedded control circuit 42 is illustrated schematically in FIG. 11. Referring to FIG. 11, the circuit 42 may include a Motorola MC68HC805C4 programmable microcontroller 50, which is loaded with a program that effects the functions described below. The microcontroller 50 may alternatively consist of a masked read only memory (ROM) which can be made and programmed to function in a manner identical to that described below for the MC68HC805C4 microcontroller 50, and which can be packaged more compactly than the programmable microcontroller 50. However, for the purpose of describing the function and operation of the invention, the following description will be directed to the MC68HC805C4 microcontroller 50.

The microcontroller 50 drives the liquid crystal display unit 24 through input ports SO through S6 and BP1 and BP2 of the LCD 24. The LCD 24 is a two-digit, seven segment, multiplexed LCD, which is commercially available from a number of sources. The microcontroller 50, in addition to driving the LCD, also senses the states of the two input switches, the slide switch 34 and the magazine switch 38. As noted above, the slide switch 34 is closed each time the slide 20 slides back on the frame 18. The magazine switch 38 is closed each time a magazine is inserted into the pistol.

The oscillator terminals OSC1 and OSC2 of the microcontroller 50 are connected to a 200 Khz crystal 52, which sets the clock speed of the microcontroller 50. A Schmidt trigger AND gate 54, together with a one megohm resistor 56 and a 0.01 microfarad capacitor 58, are configured to constitute a 50 microsecond oscillator, and are connected to the interrupt input IRQ of the microcontroller 50, so as to generate an interrupt signal every 50 microseconds. This 50 microsecond period is the main cycle period for the microcontroller 50. Each time an interrupt signal is generated the microcontroller 50 refreshes the LCD display 24 and reads the status of the slide and magazine switches 34 and 38. The microcontroller 50 includes an internal timer, which is not used in this circuit and which is deactivated by applying a high logic signal to the TCAP input terminal of the microcontroller. The TCMP terminal is the output for the internal timer, and also is not used in this application.

The slide and magazine switches 34 and 38 are connected to the C0 and C4 parallel input ports, respectively, of the microcontroller 50.

A 0.1 microfarad ceramic capacitor 60 functions as a high frequency bypass for the power supply. Resistors 62 and 64 are part of the programming network, as well as diode 66. A 100 K resistor 68 serves to produce a pull-up signal on the magazine switch line.

The slide switch 34 operates slightly differently. It is a two position, single pole, double throw switch, one of position of which is ground and the other of which is connected to power supply voltage (3 volts).

Four one megohm resistors 70, 72, 74 and 76 are used to establish three-level signals which are necessary to drive the LCD backplane through terminals BP1 and BP2 of the LCD 24. In this regard, the LCD 24 has two backplanes, one for each of the two digits of the LCD. In operation, the two backplanes are alternately activated, at a frequency which is high enough that they both appear black to an observer, and the appropriate logic signals are applied to the digit segment inputs S0 through S6. The backplane signals require three different states, represented by the power supply voltage, an intermediate voltage generated by the resistors 70 through 76, and a ground signal.

The microcontroller 50 is connectable to a programming board by means of a programming connector 78, which is the means by which a control program is loaded into the microcontroller 50. As noted above, this element may be preferably omitted from the electronic module if a masked ROM is used to perform the functions described herein.

The special function input/output ports (D0 through D7) of the microcontroller 50 are ports to internal resources of the microcontroller which are not used in this application. For example there are serial input/output ports RDI and TDO. The MISO (master in slave out), MOSI (master out slave in) and SCK are ports ordinarily used to add extra peripherals to the microcontroller.

The VPP terminal of the microcontroller 50 is the input for the programming voltage, which is higher (20 volts) than the ordinary power supply voltage. The V+terminal is the power supply input to the microcontroller 50. The eight-bit A, B and C ports are general purpose parallel I/O ports. The A0 through A6 ports are used for the digit segment signals to the LCD terminals S0 to S6. Output ports B0 and B1 are used for the backplane lines. C0 and C1 are used as inputs from the slide and magazine switches 32 and 36, respectively.

The A, B and C parallel I/O ports are also used for programming purposes. The microcontroller 50 is equipped with a programmable EEPROM which is loaded with the program desired to be loaded into the microcontroller.

A 0.1 microfarad capacitor 80 and a 100 kilohm resistor 82 are connected to the RESET terminal of the microcontroller 50 so as to generate a reset signal upon power-up of the circuit, for example each time a new battery is installed. A 20 kilohm pullup resistor 81 is interposed between the interrupt input IRQ and the +5 volt power supply. A diode 84 is interposed between the interrupt generator subcircuit and the interrupt terminal IRQ for programming purposes.

In operation, the microcontroller 50 is programmed such that, when a battery is first inserted, it initializes itself. It sets the number of cartridges in the firearm to zero, as the battery is normally installed with the gun unloaded. Upon receipt of the first interrupt signal, the microcontroller 50 refreshes the LCD to zero, and then reads the two switches 32 and 36. If the switches are both in their normal, open, states, the microcontroller 50 does nothing and awaits the next interrupt signal, with the LCD continuing to display 0.

Upon insertion of a magazine, ordinarily containing for example 8 cartridges, into the pistol, the magazine switch 38 is closed as the magazine is inserted. Upon detecting that the magazine switch 38 is closed, the microcontroller 50 sets the number of cartridges to eight and displays this number on the LCD 24.

When the slide 20 slides rearwardly on the frame 18, either upon firing of the pistol or upon manual retraction of the slide 20, the slide switch 34 is closed momentarily. This closure is detected by the microcontroller 50, which in response decrements the count of cartridges by one, and displays the result on the LCD unit 24. This is done each time the pistol is fired or the slide is manually retracted, either of which will eject a cartridge.

Upon firing of the last round in the magazine, or the eighth round in the example just given, the slide 20 is arrested in a rearward position on the frame 18 and the slide switch 34 is held in the closed position. The microcontroller 50 identifies that it has counted to zero, corresponding to an unloaded pistol with no round in the chamber.

When all but one cartridge has been expended, i.e., the cartridge count is reduced to one, the microcontroller 50 is programmed to cause the LCD to flash repeatedly with the digit one, and also causes an audio generator 86, which is connected to I/O ports C2 and C3, to produce an audible sound, serving to warn the user that only one cartridge is left.

If the magazine is removed from the pistol before all cartridges have been expended, for example to reload with a full magazine at a particularly convenient time, it will be appreciated that a cartridge will ordinarily remain in the chamber of the pistol. Consequently, upon subsequent insertion of a magazine, which is assumed to be loaded with eight cartridges, the microcontroller 50 sets the count to nine and causes this to be displayed on the LCD. In this regard, the microcontroller 50 is programmed to set the cartridge count to the magazine capacity, plus one, when the the magazine switch 38 is closed while the slide switch 34 is open. This is in contrast to the situation where the slide 20 is arrested in the rearward position, upon expending all cartridges, in which situation the cartridge count is decremented to zero until a magazine is inserted into the pistol.

The microcontroller 50 can also be selectively programmed in the field to accommodate magazines of different capacities, as well as to turn the audio indicator on or off. This is done by manually closing a SET switch 88, which is located on the back of the electronics module 22, and which activated by pressing the face of the LCD 24. The microcontroller 50 is programmed to respond to such a signal by going into a SET mode. In the SET mode, the LCD 24 initially displays a single flashing digit in the most-significant-digit position. This digit can be changed to any number between 0 and 9 by closing the slide switch 34, by pulling the slide 20 back slightly by hand. When this is done with the microcontroller 50 in the SET mode, the slide switch 34 advances by one the digit shown on the LCD 16. By then pressing the SET switch again, the second most significant digit is displayed and flashed, and this digit can then be changed to any number from 0 to 9 by manually retracting the slide up to nine times. In this manner, LCD can be changed to any desired number between 0 and 99, with the microcontroller subsequently using this number as the number of cartridges assumed to be in each magazine. Also, by pressing the SET switch 88 one more time, and subsequently retracting the slide 20 once, the audio indicator 86 can be toggled on or off. By pressing the SET switch 88 a fourth time, the microcontroller returns to the run mode and is ready for operation.

It will be appreciated that the preferred embodiment of the present invention described above can be incorporated into a conventional semiautomatic pistol with no modification or alteration of the ordinary components of the pistol. This is a significant advantage, in that no tooling, machining or other mechanical modification of the pistol is necessary to install and use the cartridge monitoring system.

Another embodiment of the present invention is illustrated in FIGS. 12 through 17. In FIGS. 12 through 17, all elements that are the same as the elements of the first embodiment, described above, are identified with like reference numerals.

Figure 12:
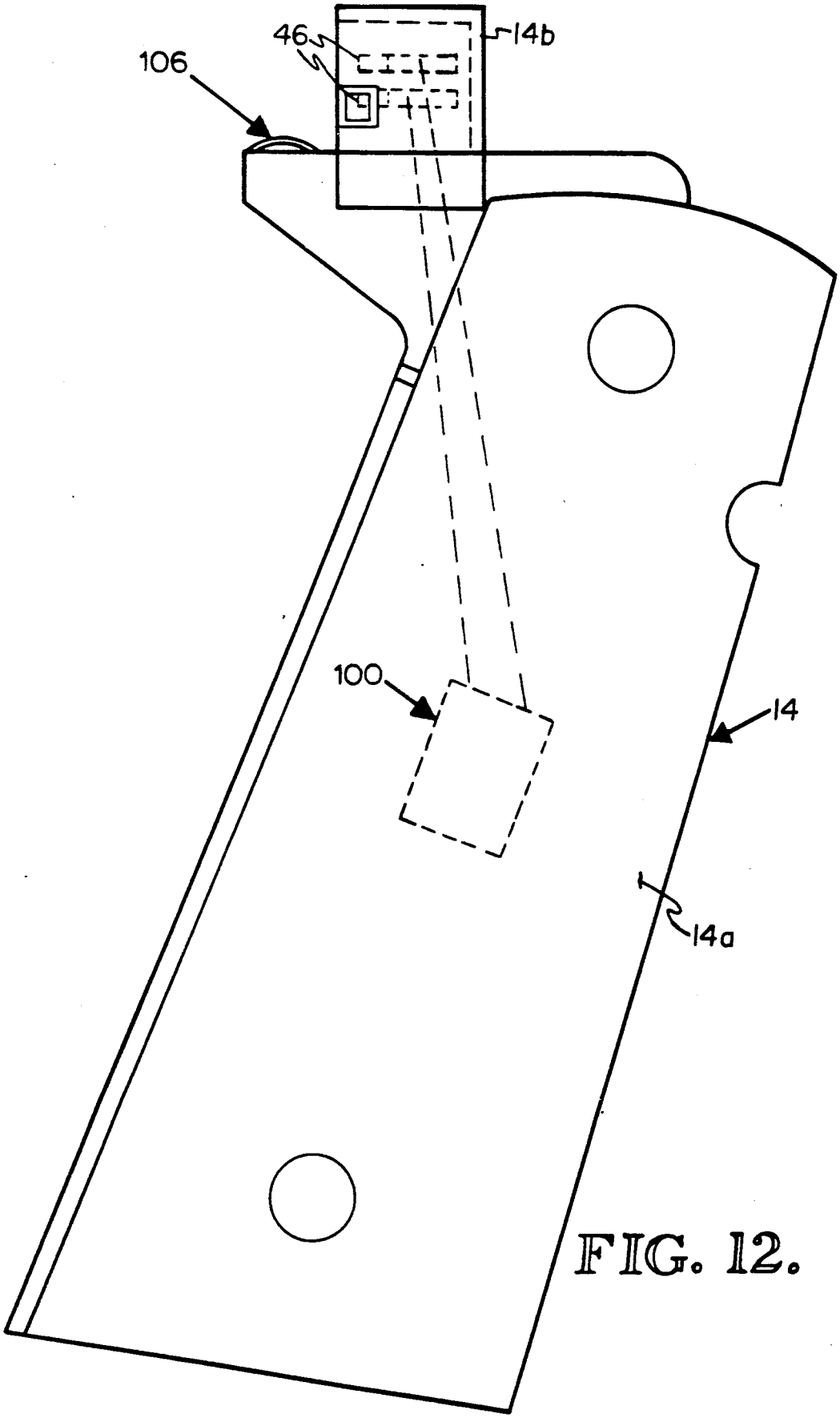
FIG. 12 is a side view of an alternative embodiment of the invention, utilizing piezoelectric motion detectors as slide and magazine sensors.
Figure 13:
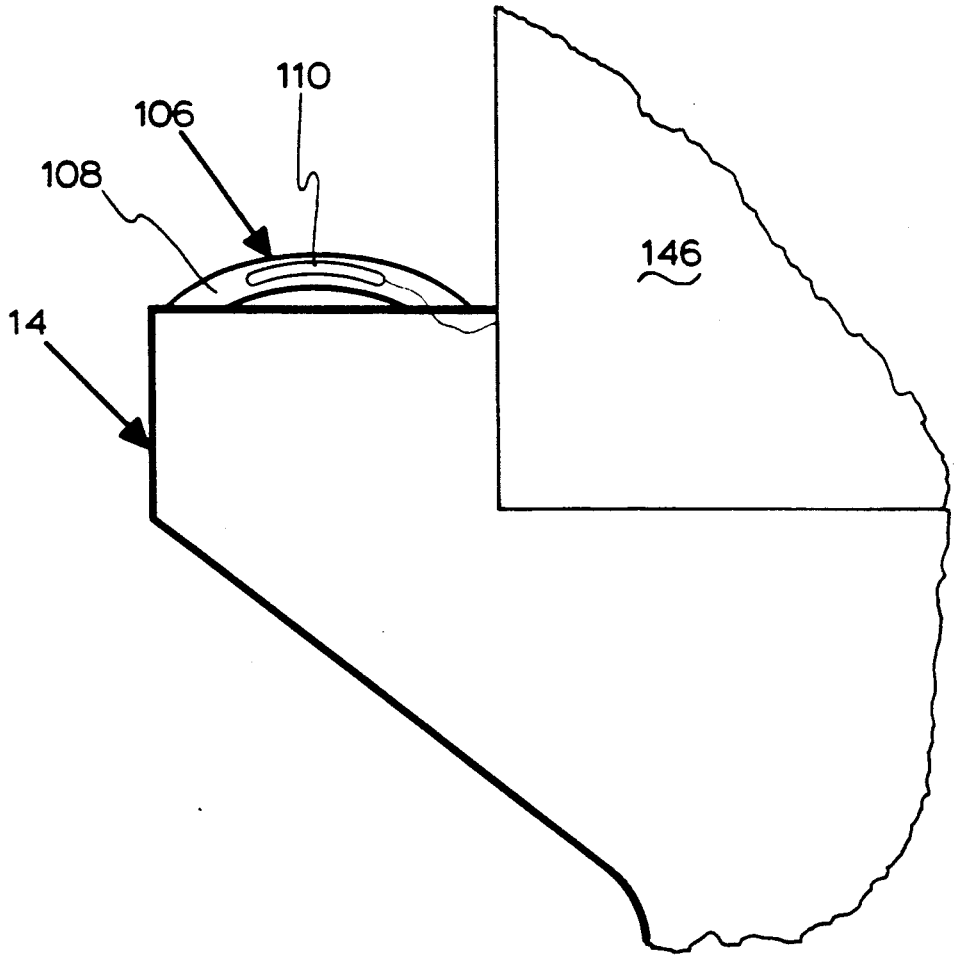
FIG. 13 is a partial enlarged side view of the alternative embodiment shown in FIG. 12.
Figure 14:
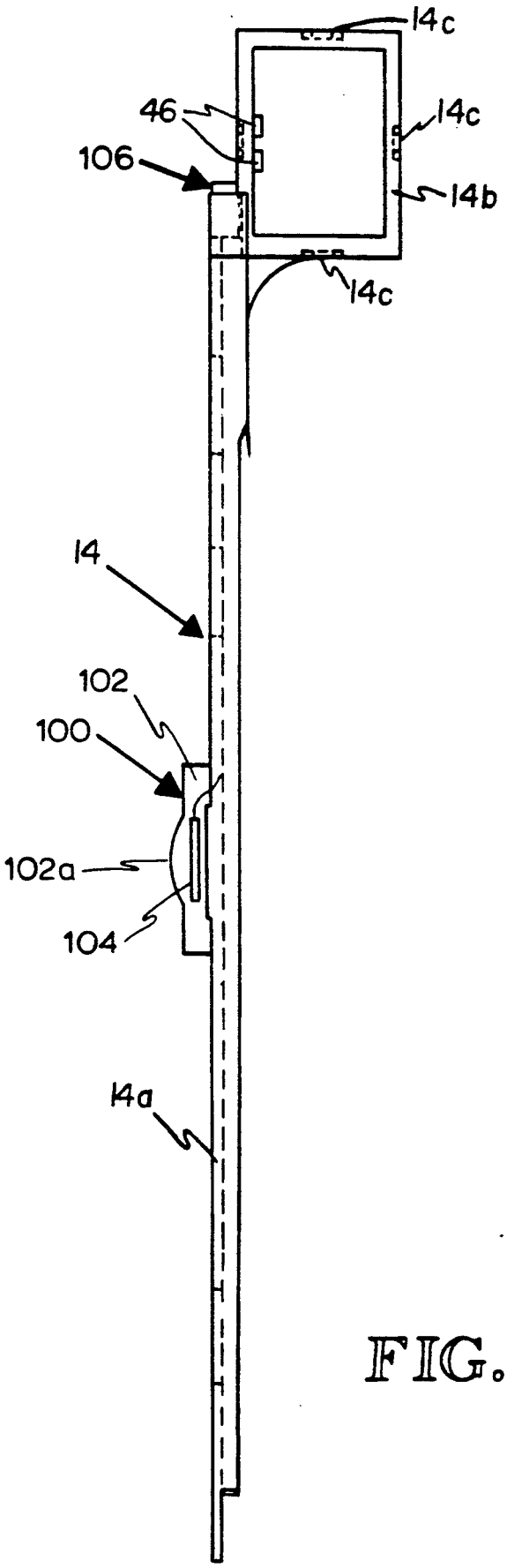
FIG. 14 is an end view of the alternative embodiment of FIG. 12.

In the embodiment of FIGS. 12 through 17, motions of the slide and magazine of the firearm are detected by a pair of piezoelectric sensor switches 100 and 102. The piezoelectric sensor switches perform the function of the slide switch and the magazine switch of the first embodiment described above. Piezoelectric sensors are preferred for this function because they require only small amounts of electric current, as opposed for example to Hall effect switches, which require relatively large amounts of electrical current. Referring to FIGS. 12 and 14, a magazine switch 100 includes of a flexible, resilient polymeric member 102, in which there is embedded a piezoelectric sensor 104.

The preferred piezoelectric sensor is a piezoelectric film sensor, which is commercially available for example from Pennwalt Corporation of Valley Forge, Pa. Piezoelectric film sensors generate an electrical signal when flexed.

The polymeric member 102 includes a rounded detent which is depressed upon insertion of a magazine into the firearm, thereby bending the piezoelectric film sensor 104 and generating an electrical signal.

Similarly, and referring to FIGS. 12 through 14, the alternative embodiment includes a slide switch 106 which includes an integral flexible detent 108, in which there is embedded a piezoelectric film sensor 110.

Figure 15:
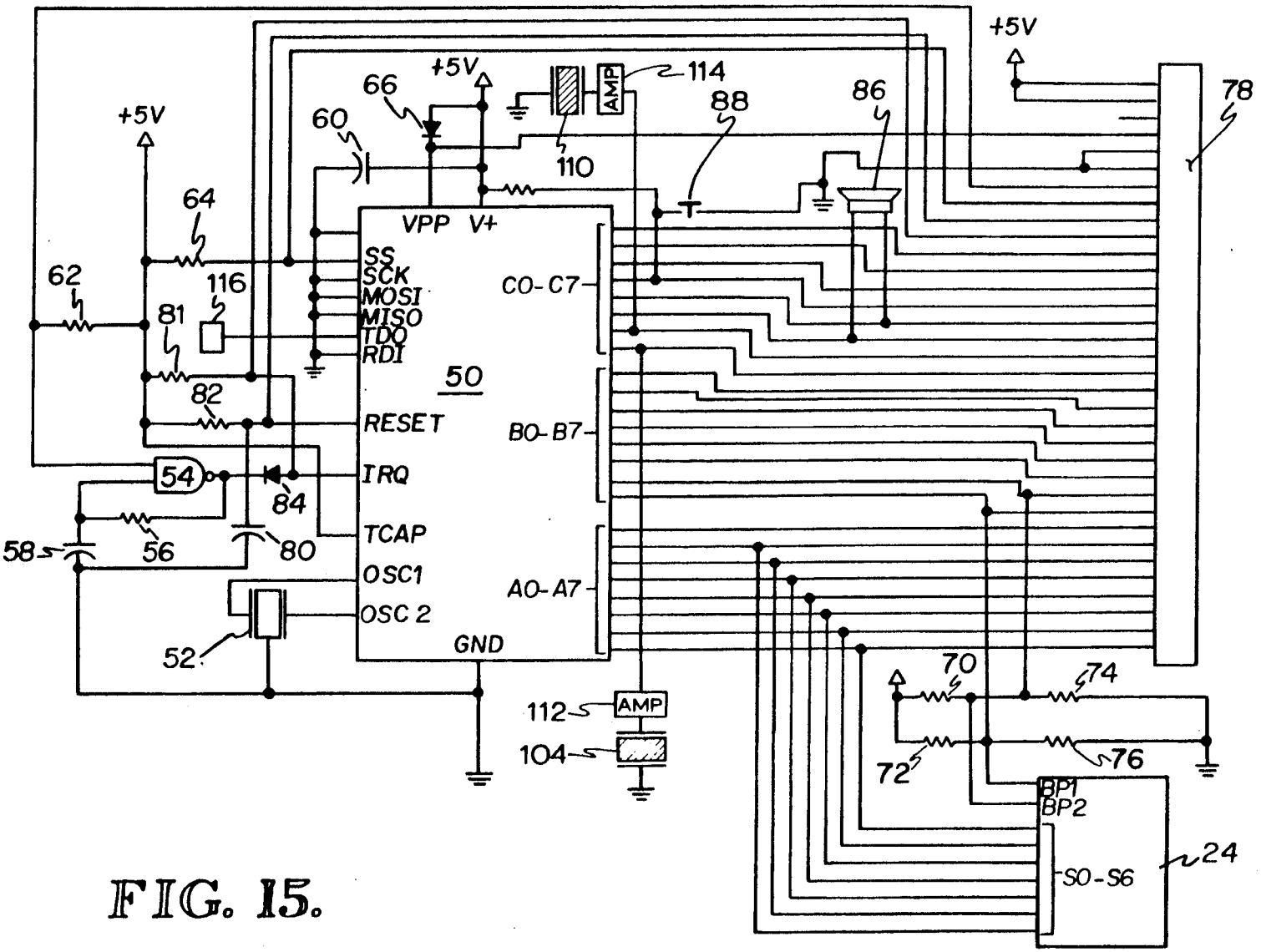
FIG. 15 is a schematic electronic circuit diagram of the embodiment shown in FIG. 12.

FIG. 15 illustrates the electrical circuit diagram for this alternative embodiment. It is characterized by the piezoelectric film sensors 104 and 110, which are connected through operational amplifiers 112 and 114, respectively, to the corresponding inputs of the microcontroller 50.

Figure 16:
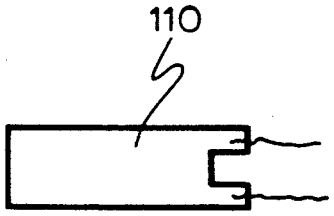
FIG. 16 is an enlarged view of the piezoelectric film motion sensor utilized in the alternative embodiment.
Figure 17:
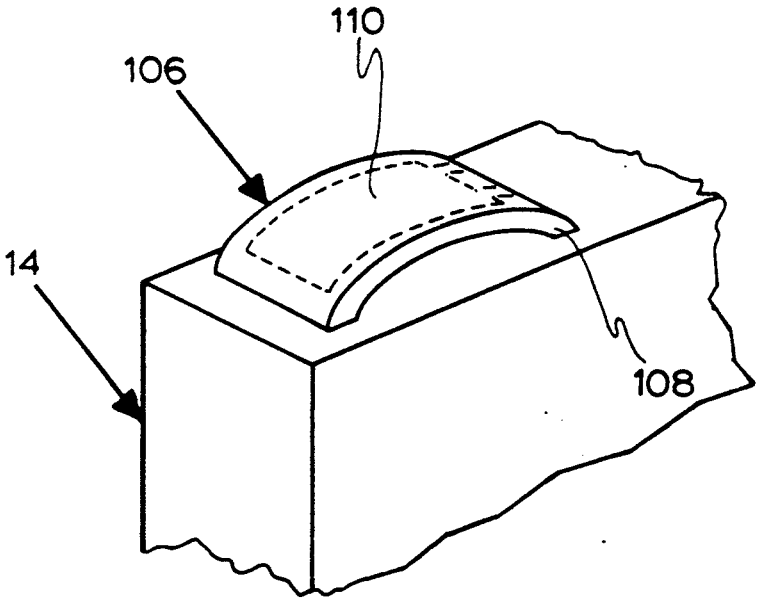
FIG. 17 is an enlarge isometric view of the piezoelectric film sensor as embedded in a flexible detent formed in the mounting strap. These Figures, taken with the following detailed description of a preferred embodiment of the invention, are intended to illustrate to one of ordinary skill in the art how to make and use an embodiment of the present invention.

FIGS. 16 and 17 illustrate the nature of the piezoelectric film sensor 110, which is in the nature of a flexible polymeric strip. It is embedded in the detent 108, such that, when the detent 108 is impacted by the pistol slide upon firing, the sensor 110 generates a suitable electrical signal.

The piezoelectric film of t he present invention is preferred as a switch means because it draws no electrical current and is impervious to moisture and other effects.

The present invention may further include a shot recording circuit, which is also illustrated in FIG. 15 and which comprises a connector 116 attached to the existing serial port on the microcontroller to provide a means of readout of the information, and a crystal controlled timebase to provide a stable timing reference for the recorder. The circuit utilizes the existing timing circuit of the microcontroller to provide a timing interrupt occurring every 0.1 to 1.0 second. The occurrence of the timing interrupt causes the microcontroller to increment an internal 24-bit register. This provides the master clock for the shot recorder.

The circuit also maintains an event buffer of a number of 24 bit (3 byte) values. The number of entries depends on requirements and available random access memory. A 20 entry table is generally adequate. The operation of this buffer is such that as events are recorded they are entered in the buffer. The buffer may be a circular buffer or a one-time buffer, depending on the application. When the circular buffer fills up the new entries overwrite the oldest entries in the buffer. In the case of the one-time buffer, new entries are discarded once the buffer is filled. For example, a police unit may issue weapons at the start of a shift and read them out at the end of the shift, to provide a permanent record of the use of the weapon during the shift. A one-time buffer is best for this type of application. If an officer retains the weapon indefinitely and uses it for practice on occasion, the circular buffer would be preferable, as the weapon would be read only after an actual incident involving the weapon.

In operation, when the firearm is fired the current value of the master clock is entered into the buffer. The represents the time the firearm was fired. Thus at any given time the buffer will contain a record of the master clock times at which the firearm was fired. The number of shots recorded in this manner may be as high as the number of registers in the buffer.

The information in the buffer cannot be erased. It may only be read out by plugging a serial port adapter between the communications connector on the device and a separate computer. The computer sends a message to the recorder to output the information stored in the circuit. The circuit first sends out the current value of the master clock, followed by the contents of the buffer. The computer then calculates the period of time elapsed since the recorded events by subtracting the value of the each entry from the master clock value to determine the time period since the event. The computer then calculates the actual time and date of each event by subtracting these time periods from the current time and date.

For example, if the master clock read 1,000,000 upon readout and the event occurred at 990,000, the event occurred 10,000 seconds previously. Subtracting this amount from the current time and date gives the time and date of the actual event.

The system lends itself to as many levels of security as needed by the application. The adapters and access to the readout computer may be controlled, and the readout command signal may be encoded or protected. The microcontroller may be programmed to retain the data in the buffer until readout in accordance with such a security arrangement.

The present invention has been described and illustrated with reference to a preferred embodiment. Nevertheless, it will be understood that various modifications, alterations and substitutions may be apparent to one of ordinary skill in the art, and that such modifications, alterations and substitutions may be made without departing from the essential invention. Accordingly, the present invention is defined only by the following claims.

The embodiments of the invention in which patent protection is claimed are:

1. In a semiautomatic or automatic firearm having a slide means which slides relative to a frame upon firing of the firearm, and wherein said firearm is loaded by magazine means inserted into said frame of said firearm and from which cartridges are fed into the firearm, a cartridge monitoring and display system comprising:

slide switch means affixed to said frame, said slide switch means including a motion sensor responsive to sliding of said slide means relative to said frame, said slide switch means being operable to produce a slide signal upon sliding of said slide means relative to said frame;

magazine switch means affixed to said frame, said magazine switch means being operable to generate a magazine signal upon insertion of a magazine into said firearm;

a programmed control circuit affixed to said frame of said firearm and operable to receive said slide and magazine signals and to ascertain therefrom the total number of cartridges that are available for firing in said magazine and in the chamber of the firearm;

a visual display unit affixed to said frame and driven by said control circuit; and wherein said programmed control circuit operates to receive said slide and magazine signals, and to produce on said visual display a visual display of the total number of cartridges contained in the firearm, including both the magazine and the chamber of the firearm.

2. The cartridge monitoring and display system defined in claim 1 wherein said slide switch means and said magazine switch means each include a piezoelectric sensor operable to produce an electric signal upon sliding of said slide means and upon insertion or removal of a magazine, respectively.

3. The cartridge monitoring and display system defined in claim 2 wherein said piezoelectric sensors are piezoelectric film sensors.

4. The cartridge monitoring and display system defined in claim 3 wherein said piezoelectric film sensors are embedded in flexible, resilient detents which support said film sensors.

5. The cartridge monitoring and display system defined in claim 1 wherein said programmed control circuit includes a microcontroller, and further comprising a shot recording circuit which comprises a connector attached to a serial port of said microcontroller to provide a means of readout of the information, a crystal controlled timebase to provide a stable timing reference for the recording circuit, and an event buffer for recording the time of events.

6. In a semiautomatic or automatic firearm having a slide means which slides relative to a frame upon firing of the firearm, and wherein said firearm is loaded by magazine means inserted into said frame of said firearm and from which cartridges are fed into the firearm, a cartridge monitoring and display system comprising:

slide switch means affixed to said frame, said slide switch means including a piezoelectric sensor that is operable to produce a slide signal upon sliding of said slide means relative to said frame;

magazine switch means affixed to said frame, said magazine switch means including a piezoelectric sensor operable to produce a magazine signal upon insertion of a magazine into said firearm;

a programmed control circuit operable to receive said slide and magazine signals and to ascertain therefrom the total number of cartridges that are available for firing in the magazine and in the chamber of the firearm;

a visual display unit affixed to said frame and driven by said control circuit; and wherein said programmed control circuit operates to receive said slide and magazine signals, and to produce on said visual display a visual display of the number of cartridges contained in the firearm.

7. The cartridge monitoring and display system defined in claim 6 wherein said piezoelectric sensors are piezoelectric film sensors.

8. The cartridge monitoring and display system defined in claim 7 wherein said piezoelectric film sensors are embedded in flexible, resilient detents which support said film sensors.

9. The cartridge monitoring and display system defined in claim 6 wherein said programmed control circuit produces an audible warning signal when only one cartridge remains available for use in said firearm.

10. The cartridge monitoring and display system defined in claim 6 wherein said programmed control circuit includes a microcontroller, and further comprising a a shot recording circuit which comprises a connector attached to a serial port of said microcontroller to provide a means of readout of the information, a crystal controlled timebase to provide a stable timing reference for the recording circuit, and an event buffer for recording the time of events.

* * * * *